US012366232B2

(12) United States Patent
Achten

(10) Patent No.: US 12,366,232 B2
(45) Date of Patent: Jul. 22, 2025

(54) HYDRAULIC DEVICE

(71) Applicant: INNAS BV, Breda (NL)

(72) Inventor: Peter Augustinus Johannes Achten, Eindhoven (NL)

(73) Assignee: INNAS BV, Breda (NL)

( * ) Notice: Subject to any disclaimer, the term of this patent is extended or adjusted under 35 U.S.C. 154(b) by 87 days.

(21) Appl. No.: 18/557,496

(22) PCT Filed: Apr. 29, 2022

(86) PCT No.: PCT/EP2022/061449
§ 371 (c)(1),
(2) Date: Oct. 26, 2023

(87) PCT Pub. No.: WO2022/229374
PCT Pub. Date: Nov. 3, 2022

(65) Prior Publication Data

US 2024/0218871 A1 Jul. 4, 2024

(30) Foreign Application Priority Data

Apr. 29, 2021 (EP) ..... 21171132

(51) Int. Cl.
*F04B 1/24* (2006.01)
*F01B 3/00* (2006.01)
(Continued)

(52) U.S. Cl.
CPC ..... *F04B 1/24* (2013.01); *F01B 3/0052* (2013.01); *F04B 1/2035* (2013.01);
(Continued)

(58) Field of Classification Search
CPC ..... F04B 1/24; F04B 1/2035; F04B 53/001; F04B 53/16; F01B 3/0052; F01B 3/0038
(Continued)

(56) References Cited

U.S. PATENT DOCUMENTS 2,356,917 A * 8/1944 Cyril ..... F01B 3/0023 91/477
2,661,695 A * 12/1953 Ferris ..... F04B 1/2085 417/457
(Continued)

FOREIGN PATENT DOCUMENTS

CN 101313148 A 11/2008
CN 101523052 A 9/2009
(Continued)

OTHER PUBLICATIONS

International Search Report and Written Opinion in corresponding International Serial No. PCT/EP2022/061449 dated Jul. 25, 2022.

*Primary Examiner* — Thomas Fink
(74) *Attorney, Agent, or Firm* — Steven M. Koehler; Westman, Champlin & Koehler, P.A.

(57) ABSTRACT

A hydraulic device comprises an outer surface of a rotor rotating and facing an outer surface of a port member. The rotor has a plurality of cylinders disposed about an axis and cooperating pistons. The cylinders communicate with respective open ends at the rotor outer surface. Each open end alternatingly communicates with high and low pressure ports. Each two successive cylinders are interconnected via a fluid displacement member having first and second openings communicating with each respective cylinder and a closure element that obstructs either the first or second opening if the pressure in the cylinder that communicates with the second opening is higher or lower than the pressure in the cylinder that communicates with the first opening, respectively. The first opening and the second opening of each two fluid displacement members which communicate with one cylinder are fluidly connected with that cylinder at opposite sides of a flow resistance.

19 Claims, 5 Drawing Sheets

(51) Int. Cl.
*F04B 1/2035* (2020.01)
*F04B 53/00* (2006.01)
*F04B 53/16* (2006.01)

(52) U.S. Cl.
CPC ..... *F04B 53/001* (2013.01); *F01B 3/0038* (2013.01); *F04B 53/16* (2013.01)

(58) Field of Classification Search
USPC ..... 417/269–271
See application file for complete search history.

(56) References Cited

U.S. PATENT DOCUMENTS

| | | | | |
|---|---|---|---|---|
| 3,057,668 | A | 10/1962 | Cornelius | |
| 3,162,142 | A | 12/1964 | Wiggermann | |
| 3,434,429 | A | 3/1967 | Goodwin | |
| 3,630,026 | A | 12/1971 | Ifield | |
| 3,648,567 | A | 3/1972 | Clark | |
| 3,948,111 | A | 4/1976 | Dittrich | |
| 3,958,456 | A | 5/1976 | Jacobson | |
| 4,096,786 | A * | 6/1978 | Schauer | F01B 3/0055 91/499 |
| 4,223,594 | A | 9/1980 | Gherner | |
| 4,361,077 | A | 11/1982 | Mills | |
| 4,363,294 | A | 12/1982 | Searle | |
| 4,703,682 | A | 11/1987 | Hansen | |
| 4,776,257 | A | 10/1988 | Hansen | |
| 5,249,506 | A | 10/1993 | Willimczik | |
| 5,304,043 | A | 4/1994 | Shilling | |
| 5,415,530 | A | 5/1995 | Shilling | |
| 5,564,327 | A | 10/1996 | Sims | |
| 5,636,561 | A | 6/1997 | Pecorari | |
| 5,778,757 | A | 7/1998 | Kristensen et al. | |
| 5,794,514 | A | 8/1998 | Pecorari | |
| 5,960,697 | A | 10/1999 | Hayase et al. | |
| 6,152,014 | A | 11/2000 | Willimczik | |
| 6,283,721 | B1 | 9/2001 | Gollner | |
| 6,293,768 | B1 | 9/2001 | Shintoku et al. | |
| 6,312,231 | B1 | 11/2001 | Kuhne et al. | |
| 6,629,822 | B2 | 10/2003 | Larkin et al. | |
| 6,663,354 | B2 | 12/2003 | Forster | |
| 6,802,244 | B1 | 10/2004 | Stoppek et al. | |
| 7,090,472 | B2 * | 8/2006 | Achten | F01B 3/104 91/472 |
| 7,311,034 | B2 | 12/2007 | Achten | |
| 7,328,647 | B2 | 2/2008 | Achten | |
| 7,470,116 | B2 | 12/2008 | Dantlgraber | |
| 7,731,485 | B2 | 6/2010 | Achten | |
| 8,297,239 | B2 | 10/2012 | Kwok | |
| 8,794,938 | B2 | 8/2014 | Frey | |
| 10,830,221 | B2 | 11/2020 | Achten | |
| 10,914,172 | B2 | 2/2021 | Achten | |
| 11,067,067 | B2 | 7/2021 | Achten | |
| 2004/0173089 | A1 | 9/2004 | Gray, Jr. et al. | |
| 2005/0017573 | A1 | 1/2005 | Achten | |
| 2005/0019171 | A1 | 1/2005 | Achten | |
| 2005/0201879 | A1 | 9/2005 | Achten | |
| 2006/0051223 | A1 | 3/2006 | Mark et al. | |
| 2006/0120881 | A1 | 6/2006 | Dantigraber | |
| 2006/0222516 | A1 * | 10/2006 | Achten | F01B 3/0041 417/269 |
| 2007/0251378 | A1 | 11/2007 | Nelson | |
| 2009/0007773 | A1 | 1/2009 | Zhu | |
| 2009/0084258 | A1 | 4/2009 | Stoelzer | |
| 2009/0196768 | A1 | 8/2009 | Nelson et al. | |
| 2009/0290996 | A1 | 11/2009 | Ishizaki | |
| 2010/0119394 | A1 | 5/2010 | Frey | |
| 2013/0195687 | A1 | 8/2013 | Achten et al. | |
| 2015/0361971 | A1 | 12/2015 | Wood | |
| 2017/0335820 | A1 | 11/2017 | Pecorari | |
| 2019/0211811 | A1 | 7/2019 | Achten | |
| 2020/0370570 | A1 | 11/2020 | Enevoldsen et al. | |

FOREIGN PATENT DOCUMENTS

| | | | | |
|---|---|---|---|---|
| CN | 115234462 | A * | 10/2022 | F04B 1/2035 |
| DE | 2130514 | A1 | 12/1972 | |
| DE | 2850803 | A * | 7/1980 | F04B 1/2014 |
| DE | 3519783 | A1 | 12/1986 | |
| DE | 102006021570 | A1 | 10/2007 | |
| DE | 102008012404 | A1 | 9/2009 | |
| EP | 1508694 | A1 | 2/2005 | |
| EP | 1855002 | A1 | 11/2007 | |
| EP | 2012010 | A1 | 1/2009 | |
| EP | 3246567 | A1 | 11/2017 | |
| GB | 2446348 | A | 8/2008 | |
| GB | 2584202 | A | 11/2020 | |
| JP | 2005514552 | A | 5/2005 | |
| JP | 2005522631 | A | 7/2005 | |
| JP | 2009531590 | A | 9/2009 | |
| NL | 1016738 | C2 | 5/2002 | |
| NL | 1016739 | C2 * | 5/2002 | F01B 3/0038 |
| NL | 1019736 | C1 | 7/2003 | |
| NL | 1020932 | C2 | 7/2003 | |
| WO | 8600662 | A1 | 1/1986 | |
| WO | 2003058035 | A1 | 7/2003 | |
| WO | 2004055369 | A1 | 7/2004 | |
| WO | 2006083163 | A1 | 8/2006 | |
| WO | 2007060822 | A1 | 5/2007 | |
| WO | 2007079707 | A1 | 7/2007 | |

* cited by examiner

HYDRAULIC DEVICE

CROSS-REFERENCE TO RELATED APPLICATION(S)

This Application is a Section 371 National Stage Application of International Application No. PCT/EP2022/061449, filed Apr. 29, 2022 and published as WO 2022/229374 A1 on Nov. 3, 2022, in English, and further claims priority to European patent application Ser. No. 21171132.0, filed Apr. 29, 2021.

BACKGROUND

The present invention relates to a hydraulic device comprising a rotor and a port member including a high-pressure port and a low-pressure port, wherein an outer surface of the rotor faces an outer surface of the port member and is rotatable with respect to the port member in a rotational direction about an axis of rotation, wherein the rotor is provided with a plurality of cylinders located at angular distance from each other about the axis of rotation and cooperating pistons which are movable within the respective cylinders, wherein the cylinders communicate with respective open ends at the outer surface of the rotor wherein each of the open ends alternatingly communicates with the high-pressure port and the low-pressure port under operating conditions, wherein each two successive cylinders of the plurality of cylinders are interconnected via a fluid displacement member having a first opening that communicates with one of the two successive cylinders, a second opening that communicates with the other one of the two successive cylinders and a closure element that is freely movable between the first and second openings and configured such that it substantially obstructs either the first opening or the second opening if under operating conditions the pressure in the cylinder that communicates with the second opening is higher or lower than the pressure in the cylinder that communicates with the first opening, respectively.

Such a hydraulic device is known from NL 1016738. The known hydraulic device has a rotor which is linked to a swashplate to move each of the pistons within the respective cylinders between bottom dead center and top dead center during rotation of the rotor. Under operating conditions a part of the cylinders communicate with the high-pressure port and another part of the cylinders communicate with the low-pressure port. Each cylinder is connected with its successive or neighboring or adjacent cylinder via a fluid displacement member. The fluid displacement member is provided with a closure element that is freely movable between a first opening and a second opening thereof. If under operating conditions the pressure of hydraulic fluid in the cylinder that communicates with the second opening is higher than the pressure of hydraulic fluid in the cylinder that communicates with the first opening the closure element can move to the first opening and substantially obstruct the first opening and if the pressure in the cylinder that communicates with the first opening is higher than the pressure in the cylinder that communicates with the second opening the closure element can move to the second opening and substantially obstruct the second opening. During movement of the closure element from the first opening to the second opening or vice versa a limited volume of hydraulic fluid flows between two successive cylinders.

When under operating conditions one of the open ends at the outer surface of the rotor travels between the high-pressure port and the low-pressure port, i.e. along a seal land of the port member, the pressure of hydraulic fluid in the cylinder that communicates with that open end changes due to changing the position of the piston within the cylinder whereas the open end is closed by the seal land. This pressure change, which is known as commutation, may lead to increased noise and vibration if the pressure at the high-pressure port differs from the pressure in the cylinder when the corresponding open end starts to communicate with the high-pressure port and/or if the pressure at the low-pressure port differs from the pressure in the cylinder when the corresponding open end starts to communicate with the low-pressure port. The known hydraulic device suppresses excessive pressure differences by means of the fluid displacement members, which are also known as shuttles, which can transfer excess hydraulic fluid between successive cylinders.

For example, considering one of the open ends travelling from the low-pressure port to the high-pressure port whereas the open end is closed by the seal land between the low-pressure port and the high-pressure port and the piston in the cylinder which communicates with the open end under consideration moves in a direction from bottom dead center to top dead center, the pressure in the cylinder that communicates with the open end under consideration increases during travelling. The successive cylinder that still communicates with the low-pressure port will remain at a lower pressure such that the closure element of the fluid displacement member that interconnects these cylinders will substantially obstruct one of the first and second openings thereof such that no or a limited amount of hydraulic fluid can flow to the successive cylinder. The other successive cylinder that already communicates with the high-pressure port will initially have a higher pressure than the cylinder which communicates with the open end under consideration when that open end travels along the seal land such that the closure element of the fluid displacement member that interconnects these cylinders will also substantially obstruct the one of the first and second openings thereof. When during travelling of the open end under consideration along the seal land the pressure in the corresponding cylinder exceeds the pressure at the high-pressure port, which equals the pressure in the successive cylinder which already communicates with the high-pressure port, the closure element of the fluid displacement member that interconnects these cylinders will move from the one of the first and second openings to the other one of the first and second openings. During this movement hydraulic fluid will flow from the cylinder which communicates with the open end under consideration to the fluid displacement member and displace its closure element, hence avoiding further pressure increase.

If the open end under consideration starts communicating with the high-pressure port before the closure element of the fluid displacement member that interconnects the successive cylinders, which successive cylinders in that condition both communicate with the high-pressure port, has substantially obstructed the other one of the first and second openings, the pressure in the cylinder that communicates with the open end under consideration is balanced with the pressure at the high-pressure port and a severe pressure difference is avoided. If the closure element substantially obstructs the other one of the first and second openings already before the open end under consideration starts communicating with the high-pressure port, the pressure in the cylinder that communicates with the open end under consideration will further rise above the pressure at the high-pressure port. Since the pressure in the cylinder will reach the pressure at the high-pressure port earlier with decreasing pressure at the high-pressure port, the distance between the first opening and the second opening should be such that the travelling distance of the closure element is sufficient to avoid an undesired pressure difference at relatively low pressure at the high-pressure port.

Similar effects as described hereinbefore happen when the open ends travel from the high-pressure port to the low-pressure port.

SUMMARY

A hydraulic device herein disclosed has in the rotor, at a distance from each open end, a flow resistance, wherein the first opening and the second opening of each two fluid displacement members which communicate with one cylinder are fluidly connected with that cylinder at opposite sides of the flow resistance.

An advantage provided is that the closure elements of the fluid displacement members are forced to predetermined positions before the open ends of the rotor reach a seal land between the low-pressure port and the high-pressure port. Under operating conditions successive cylinders which communicate with the low-pressure port create a flow of hydraulic fluid causing a pressure drop across the respective flow resistances in a direction from the corresponding open ends to the cylinders, whereas successive cylinders which communicate with the high-pressure port create a flow of hydraulic fluid causing a pressure drop across the respective flow resistances in a direction from the corresponding cylinders to the open ends. Since the first opening and the second opening of each fluid displacement member communicate with two successive or neighbouring cylinders at opposite sides of the corresponding flow resistances, the closure elements of the fluid displacement members interconnecting the two successive cylinders which communicate with either the low-pressure port or the high-pressure will be forced in the same direction. Consequently, when an open end which communicates with a cylinder arrives at a seal land the closure element of the fluid displacement member which interconnects that cylinder with a successive cylinder that arrives later at the seal land will always substantially obstruct either the first opening or the second opening thereof. This provides the opportunity to start compression or expansion at the seal land at fixed reference conditions of the fluid displacement members. This prevents the closure elements from being positioned in dependency of centrifugal forces, for example.

It is noted that when the closure element of the fluid displacement member substantially obstructs the first opening or the second opening, it minimizes fluid flow through the first opening or the second opening, respectively. This means that the first opening or the second opening are fully closed or that a very small amount of fluid still flows through the first or second opening. In the latter case, the fluid flow will usually be much smaller than the fluid flow through the first opening 25 and the second opening when the closure element moves between the first opening and the second opening.

In a practical embodiment each of the cylinders communicates with the corresponding open end through a passage in which the flow resistance is provided. The cross-sectional areas of the passages may be smaller than the cross-sectional areas of the respective cylinders. The passages as well as the fluid displacement members may be formed in a rigid unit.

The flow resistance may be formed by a local narrowing of the passage.

In an embodiment the first opening of each fluid displacement member communicates with the corresponding cylinder via a first aperture in the passage and the second opening of each fluid displacement member communicates with the corresponding cylinder via a second aperture in the passage. In a more particular embodiment, considering one of the fluid displacement members, its first opening is fluidly connected with the first aperture of the passage corresponding to a first one of the cylinders and its second opening is fluidly connected with the second aperture of the passage corresponding to the successive cylinder which follows the first one of the cylinders under operating conditions.

Preferably, the first aperture lies at a larger distance from the open end than the second aperture, since in this embodiment the flow resistance may be formed by the length of the passage between the first and second apertures. This provides a simple flow resistance such that a local narrowing of the passage may be omitted.

Each of the fluid displacement members may comprise a straight channel between the first aperture of one of two successive passages and the second aperture of the other one of the two successive passages, wherein the channel has a cylindrical portion between the first and second openings. Hence, the closure element travels within the cylindrical portion.

In a practical embodiment the closure element is a ball and the first and second openings are surrounded by respective seats which cooperate with the ball such that a fluid flow through the first opening is substantially obstructed when the ball is pressed against the seat at the first opening and a fluid flow through the second opening is substantially obstructed when the ball is pressed against the seat at the second opening. This is a simple but effective configuration of the fluid displacement members. The balls may be made of ceramic. Furthermore, the ball of the fluid displacement member may be smaller than the diameter of the cylindrical portion between the first and second openings as long as the ball substantially obstructs the first or second opening when it is pressed against the corresponding seats. Nevertheless, alternative shapes of the closure elements and/or the seats are conceivable, for example small pistons or the like. In an alternative embodiment the closure element tightly fits within the cylindrical portion between the first and second openings. In this case, corresponding seats at the first and second openings as described hereinbefore may be omitted, since the tightly fitting closure element automatically substantially obstructs the first and second openings when it is at respective opposite end positions within the cylindrical portion. As described hereinbefore, the closure element may allow a minimal leakage through the first opening or the second opening when it substantially obstructs the first opening or the second opening, respectively.

The cylindrical portion has a centerline which may lie in a plane that extends tangentially with respect to the axis of rotation at a rotational position where the cylindrical portion is located or which may be inclined with respect to that plane by an angle which is smaller than 45°, preferably smaller than 25°. This minimizes the influence of centrifugal forces on the closure elements, which might work against displacement of the closure elements by the pressure differences across the flow resistances.

In a preferred embodiment an imaginary extension of the channel in a direction from the rotor to the port member passes through the open end of the passage where its second aperture is located, since this provides the opportunity to drill the channel through the open end. Hence, drilling a separate hole which needs to be partly closed and sealed afterwards can be omitted.

In a particular embodiment the outer surfaces lie in a common plane, the axis of rotation extends perpendicularly to the outer surfaces, centerlines of the cylinders extend parallel to the axis of rotation and the high-pressure port and the low-pressure port are arc-shaped about the axis of rotation.

In a more particular embodiment the axis of rotation is a first axis of rotation and the rotor also comprises a shaft which is rotatable about a second axis of rotation and has a flange extending perpendicularly to the second axis of rotation, wherein the plurality of pistons are fixed to the flange at equiangular distance about the second axis of rotation, wherein the cylinders are separate sleeves which rest on a barrel plate in which the passages are provided, wherein the second axis of rotation intersects the first axis of rotation by an acute angle such that upon rotating the shaft each of the pistons moves reciprocatingly within the cooperating cylinder. Such a configuration may be called a floating cup hydraulic device, since the positions of the cylinders on the barrel plate are dictated by the actual positions of the cooperating pistons. In this embodiment the channel may have an imaginary extension in a direction from the port member to the cylinders which extension passes through an entrance of the passage opposite to the open end thereof, since this provides the opportunity to drill the channel through the entrance.

In an embodiment the outer surface of the port member has a first seal land between the low-pressure port and the high-pressure port where the cooperating piston of a passing open end reaches bottom dead center and a second seal land between the low-pressure port and the high-pressure port where the cooperating piston of a passing open end reaches top dead center, wherein the length of each of the first and second seal lands is larger than the length of each of the open ends, as measured in the rotational direction.

The distance between an edge of the first seal land adjacent to the low-pressure port and the location at the first seal land where the pistons reach bottom dead center may be half of the length of each open end, as measured in the rotational direction, and/or the distance between an edge of the second seal land adjacent to the high-pressure port and the location at the second seal land where the pistons reach top dead center may be half of the length of each open end, as measured in the rotational direction. This means that bottom dead center and top dead center are reached when the first and second seal lands start to close the corresponding passing open ends.

The length of the first seal land may be larger than the length of the second seal land, as measured in the rotational direction, since after leaving top dead center only a dead volume in the cylinder must be expanded by the corresponding piston whereas after leaving bottom dead center both the dead volume and a volume to be displaced by the piston must be compressed by the corresponding piston.

The hydraulic device may be a pump, motor or transformer.

BRIEF DESCRIPTION OF THE DRAWINGS

Aspects of the invention will hereafter be elucidated with reference to very schematic drawings showing embodiments of the invention by way of example.

DETAILED DESCRIPTION

Figure 1:
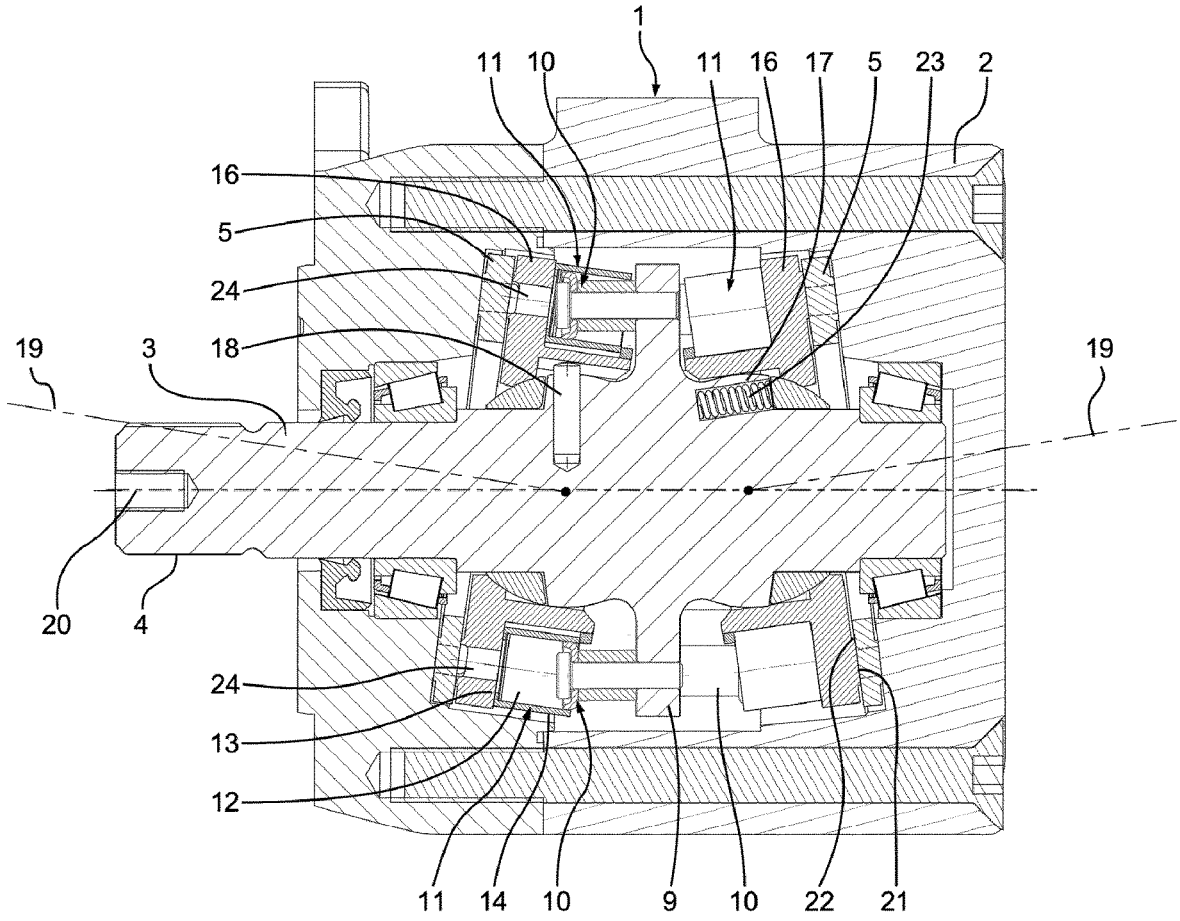
FIG. 1 is a cross-sectional view of an embodiment of a hydraulic device.

FIG. 1 shows internal parts of a hydraulic device 1, such as a pump or hydromotor, which are fitted in a housing 2 in a known manner. The hydraulic device 1 is provided with a shaft 3 which is rotatably supported by the housing 2. One side of the housing 2 is provided with an opening through which a toothed shaft end 4 of the shaft 3 protrudes from the housing 2. A motor can be coupled to the toothed shaft end 4 if the hydraulic device 1 is a pump, and a driven tool can be coupled thereto if the hydraulic device 1 is a motor.

Figure 2:
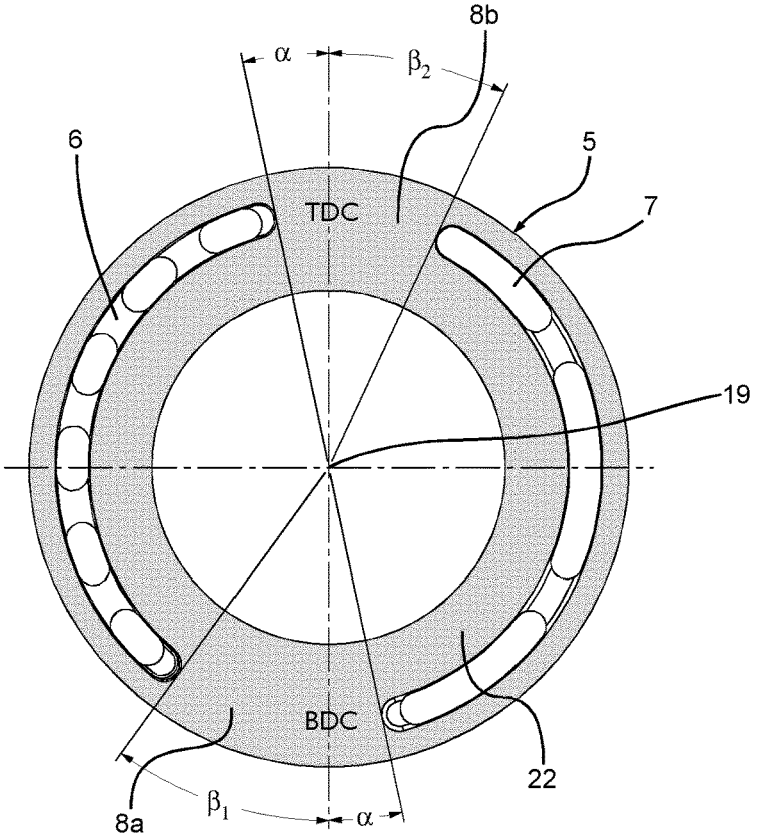
FIG. 2 is a front view of a port plate of the hydraulic device of FIG. 1.

The hydraulic device 1 comprises port members in the form of port plates 5 which are mounted inside the housing 2 at a distance from each other. FIG. 2 shows one of the port plates 5 in more detail. Each port plate 5 includes an arc-shaped high-pressure port 6 and an arc-shaped low-pressure port 7. Between the high-pressure port 6 and the low-pressure port 7 are a first seal land 8*a* and a second seal land 8*b*. The port plates 5 have fixed positions with respect to the housing 2 in rotational direction thereof, but they may be rotatable with respect to the housing 2 in an alternative embodiment (not shown). The shaft 3 extends through respective central through-holes in the port plates 5.

The shaft 3 is provided with a flange 9. At both sides of the flange 9 a plurality of pistons 10 are fixed through respective press fittings, in this case fourteen pistons 10 on either side. The pistons 10 shown in FIG. 1 are made of separate parts, but they may also be single units. Each of the pistons 10 cooperates with a separate cylinder 11 to form a compression chamber 12 of variable volume. The hydraulic device 1 as shown in FIG. 1 has 28 compression chambers 12. Each of the cylinders 11 comprises a cylinder bottom 13 and a cylinder jacket 14 which extends from the cylinder bottom 13.

Figure 3:
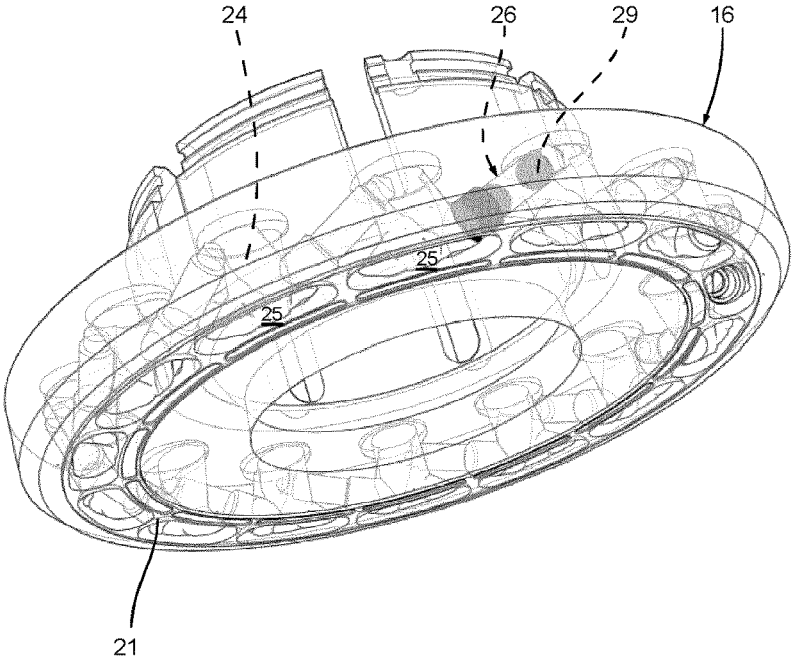
FIG. 3 is an enlarged perspective view of a barrel plate of the embodiment of FIG. 1.

The cylinder bottoms 13 of the respective cylinders 11 are supported by two barrel plates 16 which are fitted around the shaft 3 by means of respective ball hinges 17 and are coupled to the shaft 3 by means of keys 18. Consequently, the barrel plates 16 rotate together with the shaft 3 under operating conditions. FIG. 3 shows one of the barrel plates 16 in more detail. It is noted that the cylinder bottoms 13 rest on the respective barrel plates 16 but they do not have a fixed position with respect to the respective barrel plates 16.

FIG. 1 shows that the barrel plates 16 rotate about respective first axes of rotation 19 which are angled with respect to a second axis of rotation 20. The shaft 3 is rotatable about the second axis of rotation 20 and the flange 9 extends perpendicularly to the second axis of rotation 20. The pistons 10 are located at equiangular distance about the second axis of rotation 20. The pistons 10 have centerlines which extend parallel to the second axis of rotation 20. The arc-shaped low-pressure port 7 and the arc-shaped high-pressure ports 6 of each face plate 5 extend about the corresponding first axis of rotation 19. The angles between the second axis of rotation 20 and the respective first axes of rotation 19 are approximately nine degrees in practice, but may be smaller or larger.

Upon rotating the shaft 3 the barrel plates 16 and the cylinders 11 rotate about the respective first axes of rotation 19. Each cylinder 11 makes a combined translating and swivelling motion around the cooperating piston 10. Each piston 10 moves with respect to its cooperating cylinder 11 between bottom dead center BDC and top dead center TDC. As a consequence, the volume of the corresponding compression chamber 12 changes.

Each of the barrel plates 16 has an outer surface 21 which is directed away from the flange 9 and faces an outer surface 22 of the cooperating port plate 5, see FIGS. 1-3. The barrel plates 16 are pressed against the respective port plates 5 by means of springs 23 which are mounted in holes in the shaft 3. The outer surfaces 21, 22 extend perpendicularly to the respective first axes of rotation 19. Due to the inclined orientations of the outer surfaces 22 of the port plates 5 with respect to the flange 9 the barrel plates 16 pivot about the ball hinges 17 during rotation with the shaft 3.

Considering one of the barrel plates 16, the cylinders 11 which rest on the barrel plate 16 communicate via central through-holes in the respective cylinder bottoms 13 with cooperating passages 24 in the barrel plate 16. The passages 24 have respective open ends 25 at the outer surface 21 of the barrel plate 16, see FIGS. 3 and 4. In this case, each barrel plate 16 has fourteen successive open ends 25, which communicate with fourteen successive cylinders 11. Under operating conditions the open ends 25 alternatingly communicate via the high-pressure port 6 and the low-pressure port 7 with a high-pressure line and a low-pressure line (not shown), respectively, which are provided in the housing 2.

In fact, in the embodiment as shown in FIG. 1 the shaft 3, the barrel plates 16, the pistons 10, the cylinders 11, the ball hinges 17, the keys 18 and the springs 23 may be considered as parts of a rotor which has opposite outer 21 surfaces which face the outer surfaces 22 of the respective port plates 5.

Figure 4:
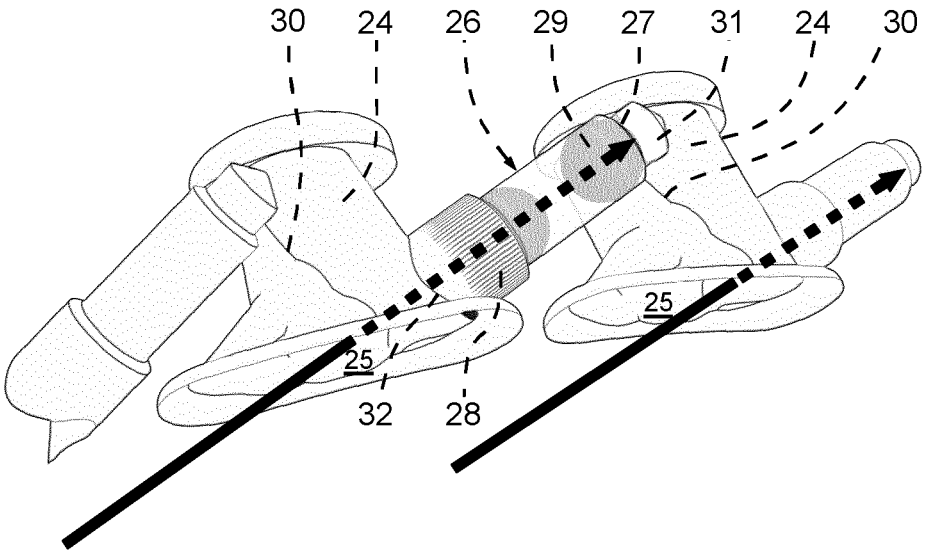
FIG. 4 is a similar view as FIG. 3, showing a part thereof on a larger scale.
Figure 5:
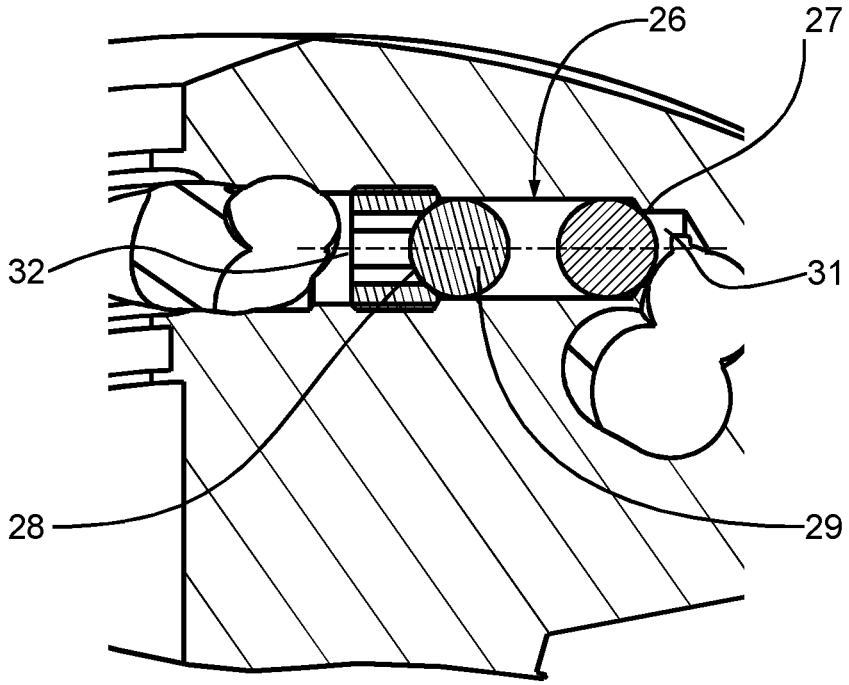
FIG. 5 is a sectional view of the part of FIG. 4.

FIGS. 3-5 show that each pair of successive passages 24 are interconnected via a fluid displacement member 26, which means that also each pair of successive cylinders 11 are interconnected via a fluid displacement member 26. Hence, each barrel plate 16 is also provided with fourteen successive fluid displacement members 26. Each of the fluid displacement members 26 comprises a channel between each pair of successive passages 24 and has a first opening 27 and a second opening 28 which are located at a distance from each other. The channel has a cylindrical portion between the first and second openings 27, 28. A closure element in the form of a ball 29 is freely movable between the first and second openings 27, 28. FIGS. 3-5 show two balls at one fluid displacement member 26 for explanatory reasons, but in reality each fluid displacement member 26 will have a single ball 29.

Referring to FIG. 4, the first opening 27 communicates with the right one of the pair of successive passages 24 and the second opening 28 communicates with the left one of the pair of successive passages 24. The first and second openings 27, 28 and the ball 29 are configured such that the ball 29 substantially obstructs the first opening 27 if under operating conditions the pressure in the passage 24 that communicates with the second opening 28, i.e. the left one in FIG. 4, is higher than the pressure in the passage 24 that communicates with the first opening 27, i.e. the right one in FIG. 4, whereas the ball 29 substantially obstructs the second opening 28 if under operating conditions the pressure in the passage 24 that communicates with the first opening 27, i.e. the right one in FIG. 4, is higher than the pressure in the passage 24 that communicates with the second opening 28, i.e. the left one in FIG. 4.

When the ball 29 moves from the first opening 27 to the second opening 28 it displaces fluid towards the passage 24 that communicates with the second opening 28 and when the ball 29 moves from the second opening 28 to the first opening 27 it displaces fluid towards the passage 24 that communicates with the first opening 27. Hence, a larger distance between the first and second openings 27, 28 creates a larger volume of fluid to be displaced between each pair of successive passages 24.

Considering one of the passages 24, it communicates with the first opening 27 and the second opening 28 of two successive fluid displacement members 26, which are located at opposite sides of the passage 24. The first opening 27 of one of the two successive fluid displacement members 26 is fluidly connected with the passage 24 via a first aperture 31 in the passage 24 and the second opening 28 of the other one of the two successive fluid displacement members 26 is fluidly connected with the passage 24 via a second aperture 32 in the passage 24. The first aperture 31 lies at a larger distance from the open end 25 of the passage 24 under consideration than the second aperture 32, see FIGS. 4 and 5. The distance between the first aperture 31 and the second aperture 32 in the passage 24 forms a flow resistance 30 between the first aperture 31 and the second aperture 32 under operating conditions, of which the effect will be explained hereinafter. In an alternative embodiment (not shown) each of the passages 24 is provided with a flow resistance in the form of a restriction where the cross-sectional area of the passage 24 is locally narrowed.

FIG. 4 illustrates by arrows how the fluid displacement members 26 can be manufactured by drilling the channels in the form of elongate stepped holes between each two successive passages 24 by inserting a drill through the open end 25 and drilling in the direction of the arrows. An advantage of this way of manufacturing is that the fluid displacement member 26 is entirely located within the barrel plate 26 which means that no sealings between different parts have to be applied.

FIG. 5 shows that the first opening 27 is close to the first aperture 31. The first opening 27 is surrounded by a seat which cooperates with the ball 29 such that a fluid flow through the first opening 27 is obstructed when the ball 29 is pressed against the seat at the first opening 29. Similarly, the second opening 28 is surrounded by a seat which cooperates with the ball 29 such that a fluid flow through the second opening 28 is obstructed when the ball 29 is pressed against the seat at the second opening 28. The seat at the second opening 28 is created by a tapered end of a socket screw 32 including a through-hole which is screwed into the drilled hole after introducing the ball 29 into the cylindrical portion of the stepped hole. Alternative structural designs are conceivable, for example a seat which is pressed, clamped or glued in the drilled hole.

Each of the elongate stepped holes has a centerline which is slightly inclined with respect to a plane that extends tangentially with respect to the first axis of rotation 19 at a rotational position where the cylindrical portion of the fluid displacement member 26 is located. This means that the influence of centrifugal forces on the balls 29 is limited. Hence, the speed of rotation of the shaft 3 has limited effect on the functioning of the fluid displacement members 26. It is noted that in the embodiment as shown in FIGS. 1-5 the elongate stepped holes can also be drilled from the opposite side of the barrel plate 16 than illustrated by the arrows in FIG. 4, preferably via entrances of the respective passages 24 which are located remote from the open ends 25, i.e. at the side of the barrel plate 16 on which the cylinder bottoms 13 rest.

It is not necessary that the ball 29 tightly fits within the cylindrical portion of the fluid displacement member 26 as long as it substantially obstructs fluid flow when the ball 29 abuts the seat of the first opening 27 or the second opening 28 to minimize leakage.

Figure 6:
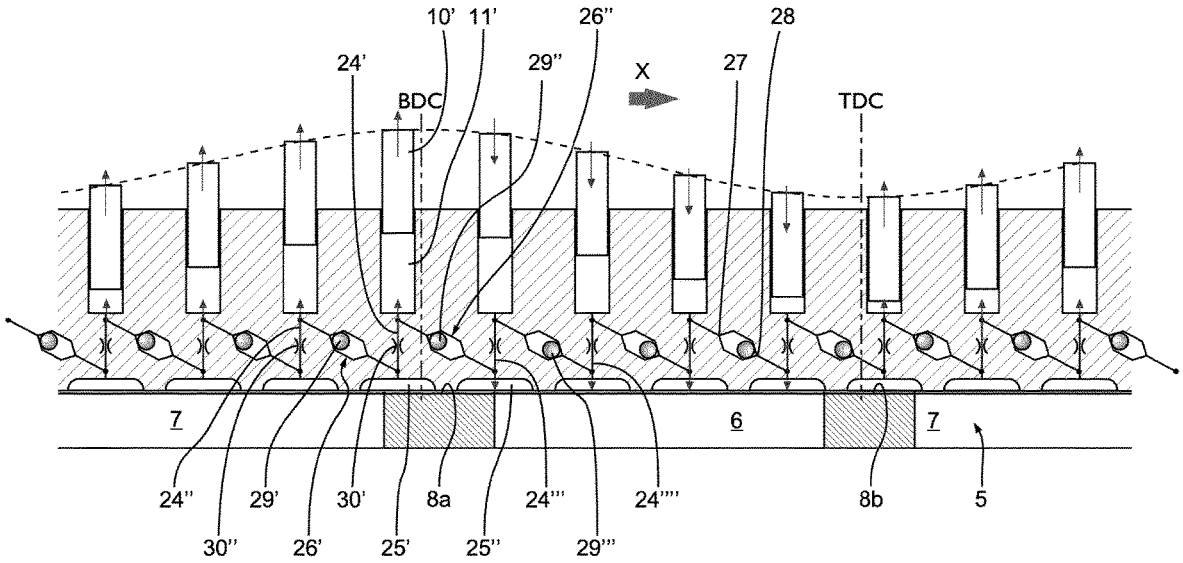
FIG. 6 is a schematic diagram, illustrating the functioning of the embodiment as shown in FIG. 1.

The functioning of the hydraulic device 1 is illustrated in FIG. 6, which shows the port plate 5 including the high-pressure port 6 and the low-pressure port 7 linearly for explanatory reasons. Furthermore, only eleven pistons 10, cylinders 11, passages 24, flow resistances 30, open ends 25 and fluid displacement members 26 are shown. The passages 24 including the flow resistances 30 and the open ends 25, the cylinders 11 and the fluid displacement members 26 are represented as parts of a unit which moves along the linear port plate 5. The direction of movement of this unit with respect to the port plate 5 is indicated by an arrow X in FIG. 6. Each of the pistons 10 passes bottom dead center BDC and top dead center TDC during movement of the corresponding open end 25 along the first seal land 8*a* between the low-pressure port 7 and the high-pressure port 6 and the second seal land 8*b* between the high-pressure port 6 and the low-pressure port 7. The length of each open end 25 in the direction of movement X is smaller than the length of each of the first and second seal lands 8*a*, 8*b* in that direction, which means that during passing each of the first and second seal lands 8*a*, 8*b* the open end 25 is closed by one of the first and second seal lands 8 within certain periods.

Preferably, the distance between an edge of the first seal land 8*a* adjacent to the low-pressure port 7 and the location at the first seal land 8*a* where the pistons 10 reach bottom dead center BDC is approximately half of the length of the open ends 25 in the direction of movement X, since compression in each of the passing cylinders 11 starts substantially in bottom dead center BDC of the corresponding piston 10. Similarly, the distance between an edge of the second seal land 8*b* adjacent to the high-pressure port 6 and the location at the second seal land 8*b* where the pistons 10 reach top dead center TDC is preferably approximately half of the length of the open ends 25 in the direction of movement X, since expansion in each of the passing cylinders 11 starts substantially in top dead center TDC of the corresponding piston 10. FIG. 2 indicates the half lengths by angles x. The half lengths are measured in rotational direction about the first axis of rotation 19.

Furthermore, the distance between the location at the first seal land 8*a* where the pistons 10 reach bottom dead center BDC and an edge of the first seal land 8*a* adjacent to the high-pressure port 6 is larger than the distance between the location at the second seal land 8*b* where the pistons 10 reach top dead center TDC and an edge of the second seal land 8*b* adjacent to the low-pressure port 7. The distances are indicated by angles β1 and β2 in FIG. 2, respectively, as measured in rotational direction. The reason that β1 is larger than β2 is that after leaving top dead center TDC only a dead volume in the cylinder 11 must be expanded whereas after leaving bottom dead center BDC both the dead volume and a stroke volume to be displaced by the piston 10 must be compressed.

When an open end 25 passes the first or second seal land 8*a*, 8*b* and is closed by it, the pressure in the cylinder 11 which communicates with the open end 25 will change since the piston 10 is still moving during such a period. When the open end 25 reaches the high-pressure port 6 or the low-pressure port 7 the pressure in the cylinder 11 and the pressure at either the high-pressure port 6 or at the low-pressure port 7 should preferably be the same or close to each other in order to avoid an excessive pressure difference causing noise emission. This is achieved by the fluid displacement members 26 between each pair of successive passages 24 and will be explained below. Arrows at the pistons 10 in FIG. 6 show the direction of movement of the pistons 10 and also indicate the flow direction of the hydraulic fluid through the passages 24 when the open ends 25 communicate with the high-pressure port 6 or the low-pressure port 7.

In FIG. 6 one of the pistons 10, its cooperating cylinder 11, passage 24 and open end 25 are indicated by reference numbers 10', 11', 24' and 25', respectively. In the situation as shown in FIG. 6 the piston 10' approaches bottom dead center BDC and the cylinder 11' still communicates with the low-pressure port 7 via the passage 24' and the open end 25'. The fluid displacement member 26 at the left side of the passage 24' and the ball 29 thereof are indicated by reference numbers 26' and 29', respectively, whereas the successive fluid displacement member 26 at the right side and its ball 29 are indicated by reference numbers 26" and 29", respectively. The successive passage 24 of passage 24' which cooperates with the fluid displacement member 26' is indicated by reference number 24" and the successive passage 24 of passage 24' which cooperates with the fluid displacement member 26" is indicated by reference number 24'". A further successive passage 24 of passage 24'" is indicated by 24"".

In the condition as shown in FIG. 6 the fluid displacement member 26' obstructs a flow from the passage 24' to the passage 24" by closing the first opening 27 thereof, whereas the fluid displacement member 26" obstructs a flow from the passage 24'" to the passage 24' by closing the first opening 27 thereof. The ball 29" of the fluid displacement member 26" is kept in that position due to the elevated pressure at the high-pressure port 6 which communicates with the passage 24'". The ball 29' of the fluid displacement member 26' is kept in its position due to the presence of the flow resistance 30; the flow resistance 30 in the passage 24' is indicated by 30' and the flow resistance 30 in the passage 24" is indicated by 30".

Since the open ends 25 which communicate with the low-pressure port 7 also communicate with the cylinders 11 in which the pistons 10 move from top dead center TDC to bottom dead center BDC, under operating conditions hydraulic fluid flows through the cooperating respective passages 24 from the low-pressure port 7 to the respective cylinders 11. This creates a lower pressure at a downstream side of each flow resistance 30, i.e. at the side where the corresponding cylinder 11 is located, than at its upstream side, i.e. the side where the open end 25 is located. Consequently, the arrangement of the fluid displacement members 26 which interconnect open ends 25 that communicate with the low-pressure port 7 as shown in FIG. 6 force the respective balls 29 of the fluid displacement members 26 in upward direction to the respective first openings 27 thereof. In other words, before the open end 25' reaches the first seal land 8*a* the ball 29' of the fluid displacement member 26' is always already in a predefined position.

It is noted that the distance between the first and second apertures 31, 32 along the passage 24 without local narrowing of the passage 24 may cause only a small pressure drop, but this may be sufficient to displace the ball 29 of the fluid displacement member 26 because of the low weight of the ball 29. For example, the ball 29 may have a diameter of 4 mm and a weight of 0.1 gram.

Referring again to FIG. 6, when the open end 25' moves further in the direction of movement X it will become entirely closed by the first seal land 8*a* when the piston 10' in the corresponding cylinder 11' reaches bottom dead center BDC. The pressure in the cylinder 11' will rise after passing bottom dead center BDC as long as the open end 25' is closed. Due to the increasing pressure the first opening 27 of the fluid displacement member 26' will remain obstructed, but when the pressure in the cylinder 11' exceeds the pressure at the high-pressure port 6 the ball 29" of the fluid displacement member 26" will move in a direction from the passage 24' towards the successive passage 24'" such that the pressure in the cylinder 11' will no longer rise or only rise a little. Consequently, when the open end 25' starts to communicate with the high-pressure port 6 the pressure in the cylinder 11' is substantially equal to the pressure at the high-pressure port 6. The distance of travelling of the ball 29" of the fluid displacement member 26" depends on the pressure level at the high-pressure port 6. A relatively low pressure at the high-pressure port 6 requires a relatively long travelling distance since the cylinder 11 will reach the low pressure level already soon during movement of the open end 25' along the first seal land 8*a*.

After the open end 25' has passed the first seal land 8*a* and moves along the high-pressure port 6 the ball 29" will be moved to or remain automatically to its position which is required before arriving at the second seal land 8*b* where the piston 10' passes top dead center TDC. At a downstream side of each flow resistance 30, i.e. at the side where the open end 25 is located, the pressure is lower than at an upstream side, i.e. the side where the cylinder 11 is located. This forces the ball 29'" to the lower position as shown in FIG. 6, such that it obstructs a flow from the passage 24'" to the successive passage 24"" by obstructing the second opening 28 thereof.

It is important that each of the balls 29 of the respective fluid displacement members 26 has a predefined position before the open ends 25 arrive at the respective first and second seal lands 8*a*, 8*b*. If, for example, the ball 29' in FIG. 6 would have an intermediate position anywhere between the first and second openings 27, 28 before arriving at the first seal land 8*a* the ball 29' would be moved first to its correct upper position upon closing the open end 25', which leads to a later start of compression in the cylinder 11', hence creating an undefined starting condition of compression in the cylinder 11' after the corresponding piston 10' passes bottom dead center BDC.

A similar effect as described hereinbefore when the open ends 25 pass the first seal land 8*a* also occurs when the open ends 25 pass the second seal land 8*b* and the piston 10 of the cylinder 11 that communicates with that open end 25 passes top dead center TDC. When the open end 25 is closed by the second seal land 8*b* and the piston 10 moves from top dead center TDC towards bottom dead center BDC, the pressure in the cylinder 11 decreases such that the ball 29 of the fluid displacement member 26 which interconnects the cylinder 11 with the successive cylinder 11 that follows the cylinder 11 under operating conditions will remain at the same position, i.e. closing the second opening 28, whereas the ball 29 of the other successive fluid displacement member 26 may be displaced towards the first opening 27 as soon as the pressure in the cylinder 11 becomes lower than the pressure at the low-pressure port 7. The ball 29 will be moved to or remain automatically at the first opening 27, i.e. an upper position in FIG. 6, before arriving at the first seal land 8*a*.

Figure 7:
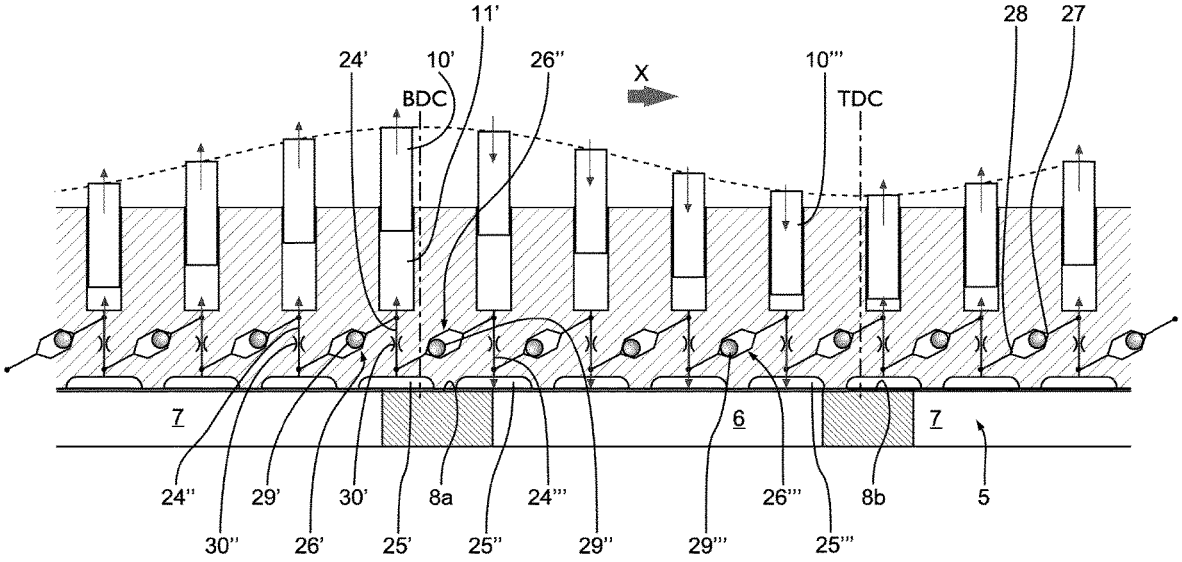
FIG. 7 is a similar view as FIG. 6, illustrating the functioning of another embodiment.

FIG. 7 shows an alternative embodiment in which the arrangement of the fluid displacement members 26 is different, but functions in a similar way as the embodiment which is shown in FIG. 6. In this case the open ends 25 which communicate with the low-pressure chamber 7 force the balls 29 of the corresponding fluid displacement members 26 upwardly. FIG. 7 illustrates that the ball 29' of the fluid displacement member 26' obstructs the first opening 27 when the open end 25' arrives at the first seal land 8*a*. Since the open end 25" already communicates with the high-pressure port 6 the ball 29" of the fluid displacement member 29" is forced to a lower position and obstructs the second opening 28 thereof. As soon as the open end 25' is closed by the first seal land 8*a* the piston 10' will start to move from bottom dead center BDC and the pressure in the cylinder 11 will start to rise. Consequently, the ball 29' will immediately move downwardly and obstruct a flow from the passage 24' to the passage 24". Subsequently, when the pressure in the cylinder 11' exceeds the pressure at the high-pressure port 6 the ball 29" of the fluid displacement member 26" will move in a direction from the passage 24' towards the successive passage 24'", i.e. upwardly, but as soon as the open end 25' communicates with the high-pressure port 6 the ball 29" will be forced downwardly because of the arrangement of the fluid displacement members 26.

A reversed effect is achieved at the second seal land 8*b*. Referring to FIG. 7, the ball 29'" remains at the lower position until the piston 10'" reaches top dead center TDC whereas the open end 25'" is closed by the second seal land 8*b*. After passing top dead center TDC the ball 29'" will immediately move upwardly.

Since the balls 29 of the fluid displacement members 26 must be displaced immediately between the first and second openings 27, 28 after passing top dead center TDC or bottom dead center BDC so as to start expansion or compression, respectively, the first and second seal lands 8*a*, 8*b* of the arrangement of the fluid displacement members 26 as illustrated in FIG. 7 will be larger than of the arrangement of the fluid displacement members 26 as illustrated in FIG. 6, as measured in the direction of movement X.

Figure 8:
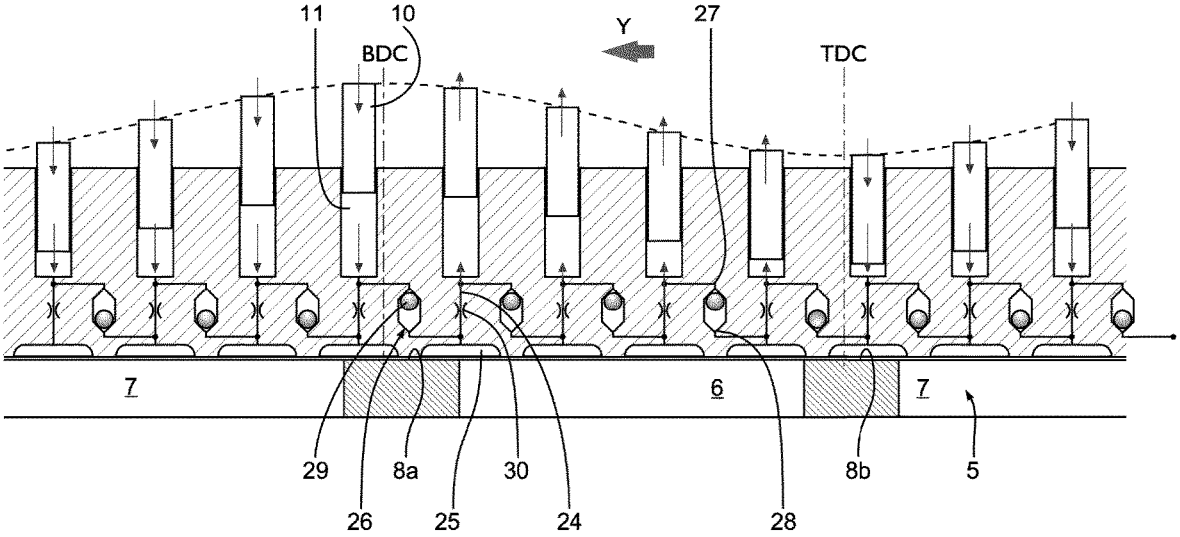
FIG. 8 is a similar view as FIG. 6, illustrating the functioning of still another embodiment.

FIG. 8 shows another alternative embodiment in which the hydraulic device 1 is applied as a motor. The passages 24 including the flow resistances 30 and the open ends 25, the cylinders 11 and the fluid displacement members 26 are represented as parts of a unit which moves along the linear port plate 5 in a direction of movement Y which is opposite to the direction of movement X in the embodiments as shown in FIGS. 7 and 8. The functioning of the fluid displacement members 26 is comparable to the embodiments as illustrated in FIGS. 6 and 7.

The invention is not limited to the embodiments shown in the drawings and described hereinbefore, which may be varied in different manners within the scope of the claims and their technical equivalents. For example, the hydraulic device may be a slipper type axial pump or motor having cylinders in a block or the hydraulic device may be a transformer.

The invention claimed is:

1. A hydraulic device comprising a rotor and a port member including a high-pressure port and a low-pressure port, wherein an outer surface of the rotor faces an outer surface of the port member and is rotatable with respect to the port member in a rotational direction about an axis of rotation, wherein the rotor is provided with a plurality of cylinders located at angular distance from each other about the axis of rotation and cooperating pistons which are movable within the respective cylinders, wherein the cylinders communicate with respective open ends at the outer surface of the rotor wherein each of the open ends alternatingly communicates with the high-pressure port and the low-pressure port under operating conditions, wherein each two successive cylinders of the plurality of cylinders are interconnected via a fluid displacement member having a first opening that communicates with one of the two successive cylinders, a second opening that communicates with the other one of the two successive cylinders and a closure element that is freely movable between the first and second openings and configured such that the closure element substantially obstructs either the first opening or the second opening if under operating conditions the pressure in the cylinder that communicates with the second opening is higher or lower than the pressure in the cylinder that communicates with the first opening, respectively, wherein in the rotor at a distance from each open end a flow resistance is provided, wherein the first opening and the second opening of each two fluid displacement members which communicate with one cylinder are fluidly connected with that cylinder at opposite sides of the flow resistance.

2. The hydraulic device according to claim 1, wherein each of the cylinders communicates with the corresponding open end through a passage in which the flow resistance is provided.

3. The hydraulic device according to claim 2, wherein the flow resistance is formed by a local narrowing of the passage.

4. The hydraulic device according to claim 3, wherein the first opening of each fluid displacement member communicates with the corresponding cylinder via a first aperture in the passage and the second opening of each fluid displacement member communicates with the corresponding cylinder via a second aperture in the passage.

5. The hydraulic device according to claim 4, wherein the first aperture lies at a larger distance from the open end than the second aperture.

6. The hydraulic device according to claim 5, wherein each of the fluid displacement members comprises a straight channel between the first aperture of one of two successive passages and the second aperture of the other one of the two successive passages, wherein the channel has a cylindrical portion between the first and second openings.

7. The hydraulic device according to claim 6, wherein the closure element is a ball and the first and second openings are surrounded by respective seats which cooperate with the ball such that a fluid flow through the first opening is substantially obstructed when the ball is pressed against the seat at the first opening and a fluid flow through the second opening is substantially obstructed when the ball is pressed against the seat at the second opening.

8. The hydraulic device according to claim 6, wherein the cylindrical portion has a centerline which lies in a plane that extends tangentially with respect to the axis of rotation at a rotational position where the cylindrical portion is located or is inclined with respect to that plane by an angle which is smaller than 45°.

9. The hydraulic device according to claim 6, wherein an imaginary extension of the channel in a direction from the rotor to the port member passes through the open end of the passage where its second aperture is located.

10. The hydraulic device according to claim 2, wherein the outer surfaces lie in a common plane, the axis of rotation extends perpendicularly to the outer surfaces, centerlines of the cylinders extend parallel to the axis of rotation and the high-pressure port and the low-pressure port are arc-shaped about the axis of rotation.

11. The hydraulic device according to claim 10, wherein the axis of rotation is a first axis of rotation and the rotor also comprises a shaft which is rotatable about a second axis of rotation and has a flange extending perpendicularly to the second axis of rotation, wherein the pistons are fixed to the flange at equiangular distance about the second axis of rotation, wherein the cylinders are separate sleeves which rest on a barrel plate in which the passages are provided, wherein the second axis of rotation intersects the first axis of rotation by an acute angle such that upon rotating the shaft each of the pistons moves reciprocatingly within the cooperating cylinder.

12. The hydraulic device according to claim 1, wherein the outer surface of the port member has a first seal land between the low-pressure port and the high-pressure port where the cooperating piston of a passing open end reaches bottom dead center and a second seal land between the low-pressure port and the high-pressure port where the cooperating piston of a passing open end reaches top dead center, wherein a length of each of the first and second seal lands is larger than a length of each of the open ends, as measured in the rotational direction.

13. The hydraulic device according to claim 12, wherein the distance between an edge of the first seal land adjacent to the low-pressure port and a location at the first seal land where the pistons reach bottom dead center is half of the length of each open end, as measured in the rotational direction, and wherein the distance between an edge of the second seal land adjacent to the high-pressure port and a location at the second seal land where the pistons reach top dead center is half of the length of each open end, as measured in the rotational direction.

14. The hydraulic device according to claim 12, wherein the length of the first seal land is larger than the length of the second seal land, as measured in the rotational direction.

15. The hydraulic device according to claim 1, wherein the hydraulic device is a pump, motor or transformer.

16. The hydraulic device according to claim 12, wherein the distance between an edge of the first seal land adjacent to the low-pressure port and the location at the first seal land where the pistons reach bottom dead center (BDC) is half of the length of each open end, as measured in the rotational direction.

17. The hydraulic device according to claim 12, wherein the distance between an edge of the second seal land adjacent to the high-pressure port and the location at the second seal land where the pistons reach top dead center (TDC) is half of the length of each open end, as measured in the rotational direction.

18. The hydraulic device according to claim 8, wherein the angle is smaller than 25°.

19. The hydraulic device according to claim 2, wherein the first opening of each fluid displacement member communicates with the corresponding cylinder via a first aperture in the passage and the second opening of each fluid displacement member communicates with the corresponding cylinder via a second aperture in the passage.

* * * * *